US006821142B1

(12) United States Patent
Rayev et al.

(10) Patent No.: US 6,821,142 B1
(45) Date of Patent: Nov. 23, 2004

(54) ELECTRICAL CONNECTOR WITH CROSSTALK REDUCTION AND CONTROL

(75) Inventors: Alexander B. Rayev, Hopedale, MA (US); Shadi AbuGhazaleh, Gales Ferry, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/378,069

(22) Filed: Mar. 4, 2003

(51) Int. Cl.[7] ..... H01R 11/20

(52) U.S. Cl. ..... 439/418; 439/676; 439/941; 439/344

(58) Field of Search ..... 439/418, 676, 439/941, 694, 344, 502, 289, 660

(56) References Cited

U.S. PATENT DOCUMENTS

| | | | | |
|---|---|---|---|---|
| 4,054,350 A | * | 10/1977 | Hardesty | 439/418 |
| 4,160,575 A | | 7/1979 | Schraut | |
| 4,950,176 A | | 8/1990 | Cocco et al. | |
| 5,186,647 A | | 2/1993 | Denkmann et al. | |
| 5,226,835 A | | 7/1993 | Baker, III et al. | |
| 5,309,630 A | | 5/1994 | Brunker et al. | |
| 5,310,363 A | | 5/1994 | Brownell et al. | |
| 5,403,200 A | | 4/1995 | Chen | |
| 5,432,484 A | | 7/1995 | Klas et al. | |
| 5,459,643 A | | 10/1995 | Siemon et al. | |
| 5,513,065 A | | 4/1996 | Caveney et al. | |
| 5,601,447 A | | 2/1997 | Reed et al. | |
| 5,626,497 A | | 5/1997 | Bouchan et al. | |
| 5,628,647 A | | 5/1997 | Rohrbaugh et al. | |
| 5,679,027 A | | 10/1997 | Smith | |
| 5,700,167 A | | 12/1997 | Pharney et al. | |
| 5,716,237 A | | 2/1998 | Conorich et al. | |
| 6,007,368 A | * | 12/1999 | Lorenz et al. | 439/418 |
| 6,227,899 B1 | | 5/2001 | Bogese, II | |
| 6,238,231 B1 | | 5/2001 | Chapman et al. | |
| 6,250,949 B1 | | 6/2001 | Lin | |
| 6,290,524 B1 | | 9/2001 | Simmel | |
| 6,319,048 B1 | * | 11/2001 | Aekins et al. | 439/418 |
| 6,364,715 B1 | | 4/2002 | Liu et al. | |
| 6,402,559 B1 | * | 6/2002 | Marowsky et al. | 439/676 |
| 6,517,377 B2 | * | 2/2003 | Vaden | 439/502 |

* cited by examiner

*Primary Examiner*—Gary Paumen
*Assistant Examiner*—Edwin A. Leon
(74) *Attorney, Agent, or Firm*—Mark S. Bicks; Alfred N. Goodman

(57) ABSTRACT

An electrical connector includes a dielectric body that has an input end, an opposite output end, and first and second non-insulated conductive members supported by the dielectric body. The first non-insulated conductive member has a first contact end and an opposite first wire connection end. The second non-insulated conductive member has a second contact end and an opposite second wire connection end. Each of the first and second contact ends are proximate the output end of the dielectric body and form a first pair of electrical contacts. Each of the second wire connection ends are proximate the input end of the dielectric body. First and second insulated conductive members are supported by the dielectric body. Each of the first and second insulated conductive members are connected to one of a second pair of electrical contacts, respectively. The first and second pairs of electrical contacts form an array of electrical contacts at the output end of the dielectric body.

36 Claims, 3 Drawing Sheets

ELECTRICAL CONNECTOR WITH CROSSTALK REDUCTION AND CONTROL

FIELD OF THE INVENTION

The present invention relates to an electrical connector that reduces crosstalk particularly in high performance data transmissions. More specifically, the present invention relates to an electrical connector, such as a telecommunication plug, receivable in a another connector, such as a jack, that combines twisted wire pairs and conductive lead frames to reduce and control crosstalk levels.

BACKGROUND OF THE INVENTION

Advancements in telecommunications require high speed data transmission. Conventional electrical connectors, such as telecommunication plugs and jacks, can produce unacceptable levels of crosstalk due to imbalance in the coupling between the wires of the connectors, thereby degrading the mated electrical performance and the transmission of data. Conventional plugs and jacks terminate up to eight wires of a cable that are close together and parallel leading to excessive crosstalk. Specifically, the eight wires are split into wire pairs 1 through 4 with the ends of wire pairs 1 through 4 being connected to their respective terminal positions 1 through 8. The crosstalk problem is further complicated by industry standards which require specific terminal assignments for each pair of wires. These terminal assignments for the wire pairs result in one wire pair, such as wire pair 3, straddling another wire pair, such as wire pair 2, creating additional crosstalk. The coupling imbalance signals of the wires of pair 2 connected to terminals 1 and 2, respectively, to other wires is canceled due to the close proximity and twisting of the two wires. Similarly, the signal coupling of the wires of pair 1 connected to terminals 4 and 5 will also be canceled and the signals of the wires of pair 4 connected to terminals 7 and 8 will likewise be canceled. However, the wires of pair 3 are required to connect to terminals 3 and 6. To meet this requirement, wire pair 3 must straddle wire pair 1. This creates an imbalance in the signals or inductance/capacitance of the wires because the wire of pair 3 connected to terminal 3 is not adjacent to the wire of wire pair 3 connected to terminal 6.

A conventional solution to this crosstalk problem is to twist each pair of wires coming into the connector. Specifically, when wires of a pair are twisted their equal and opposite signals generate reactance that cancel each other resulting in a reduction of crosstalk between the wires. However, this solution is often inadequate for high speed data transmissions as it may not provide sufficient consistency and control of the level of crosstalk which needs to fall within a specified level. This is particularly difficult due to the requirement of splitting wire pair 3 to straddle wire pair 2. Another solution to the problem of crosstalk, is to connect each wire of the connector to a lead frame that is in turn connected to a respective terminal position 1 though 8. Although this solution creates a balance of inductance/capacitance of the wires required to reduce crosstalk and eliminates the need for twisting pairs of wires, exclusive use of lead frames is cost prohibitive.

Examples of conventional electrical connectors include U.S. Pat. Nos. 6,238,231 to Chapman et al., 5,226,835 to Baker, III et al., 5,186,647 to Denkmann et al. and 5,601,447 to Reed et al., the subject matter of each of which are herein incorporated by reference.

SUMMARY OF THE INVENTION

Accordingly, an object of the present invention is to provide an electrical connector that reduces and controls crosstalk in high speed data transmission applications.

Another object of the present invention is to provide an electrical connector that combines lead frames and twisted wire pairs to reduce and control crosstalk.

Yet another object of the present invention is to provide an electrical connector that both controls crosstalk and is inexpensive to manufacture.

The foregoing objects are basically attained by an electrical connector, comprising a dielectric body having an input end and an opposite output end; first and second non-insulated conductive members supported by the dielectric body, the first non-insulated conductive member having a first contact end and an opposite first wire connection end and the second non-insulated conductive member having a second contact end and an opposite second wire connection end, each of the first and second contact ends being proximate the output end of the dielectric body and forming a first pair of electrical contacts, and each of the second wire connection ends being proximate the input end of the dielectric body; and first and second insulated conductive members supported by the dielectric body, each of the first and second insulated conductive members being connected to one of a second pair of electrical contacts, respectively, and the first and second pairs of electrical contacts forming an array of electrical contacts at the output end of the dielectric body.

The foregoing objects are also attained by an electrical connector, comprising a dielectric body having an input end and an opposite output end; first and second non-insulated conductive lead frames supported by the dielectric body, each of the first and second non-insulated conductive members having opposite contact and wire connection ends at the output and input ends of the dielectric body, and a main portion disposed there between, each main portion having a first section located proximate the wire connection end, a second section located proximate the contact end, and an angled section disposed between the first and second sections, the first sections of each of the conductive frames being substantially parallel and the second sections of each of the conductive frames being substantially parallel, and the angled sections diverging from one another toward the output end of the dielectric body, and first and second twisted insulated wires supported by the dielectric body, each of the first and second twisted insulated wires being connected to one of a second pair of electrical contacts and the first and second pairs of electrical contacts forming an array of electrical contacts at the output end of the dielectric body.

By structuring the electrical connector in the above manner, crosstalk is controlled and reduced and manufacturing costs are reduced. Other objects, advantages and salient features of the invention will become apparent from the following detailed description, which, taken in conjunction with annexed drawings, disclosing preferred embodiments of the present invention.

BRIEF DESCRIPTION OF THE DRAWINGS

Referring to the drawings which form a part of this disclosure.

DETAILED DESCRIPTION OF THE PREFERRED EMBODIMENTS

Figure 1:
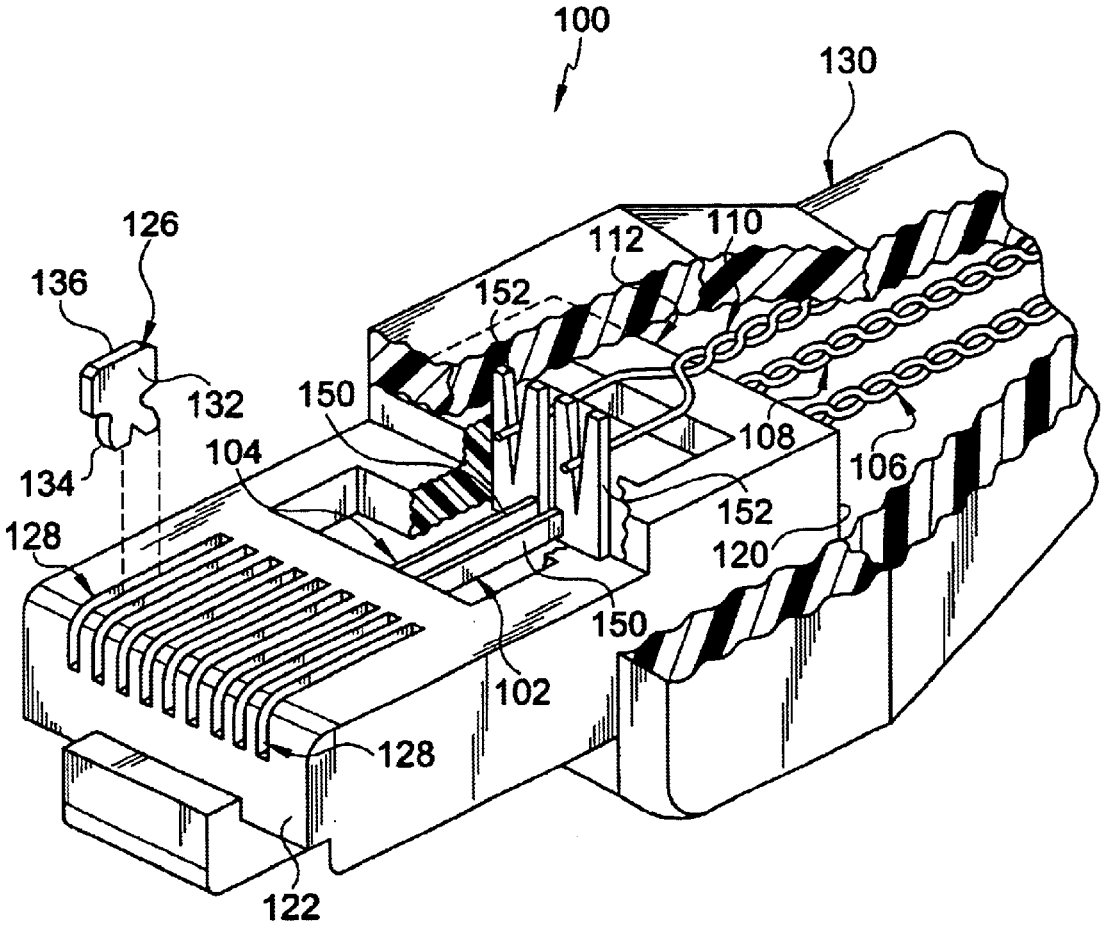
FIG. 1 is a partial perspective view of an electrical connector in accordance with a first embodiment of the present invention, showing the electrical connector connected to cable wires and a boot secured to the end of the connector.

Referring to FIGS. 1–5, an electrical connector 100 in accordance with a first embodiment of the present invention is used for high speed data transmission and is adapted to connect with another corresponding electrical connector (not shown), such as a jack. Electrical connector 100 is preferably a cable termination plug that maintains a balance of inductance and capacitance to reduce and control crosstalk by combining non-insulated conductive members 102 and 104, such as conductive lead frames or blades, with insulated conductive members 106, 108 and 112, such as insulated wire pairs, that are twisted in a conventional manner. To reduce and control crosstalk, focus is placed on the pair combinations that require the tightest control, typically the split pair at terminal positions 3 and 6 and the pair at terminal positions 4 and 5. More specifically, crosstalk is controlled by fixing the locations of lead frames 102 and 104 at the problem positions, i.e. 3 and 6, in combination with the natural crosstalk cancellation from to the twist of the other wire pairs.

Figure 3:
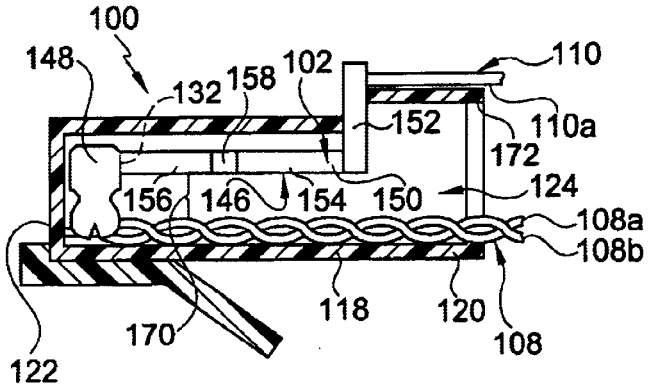
FIG. 3 is a partial side elevational view in section of the electrical connector illustrated in FIG. 1, showing a single wire pair and lead frame.

Electrical connector 100 includes a dielectric body 118 of conventional design that includes opposite input and output ends 120 and 122 with an inner receiving area 124, seen in FIG. 3, therebetween. Input end 120 is adapted to receive insulated wire pairs 106, 108 and 112. A conventional jacket or boot 130 is disposed on the input end 120 of body 118. Output end 122 includes an array of electrical contacts 126 that engage corresponding contacts of the other electrical connector (not shown), such as a jack. Each of the contacts is individually received in one of a row of slots 128 in dielectric body 118.

Figure 2:
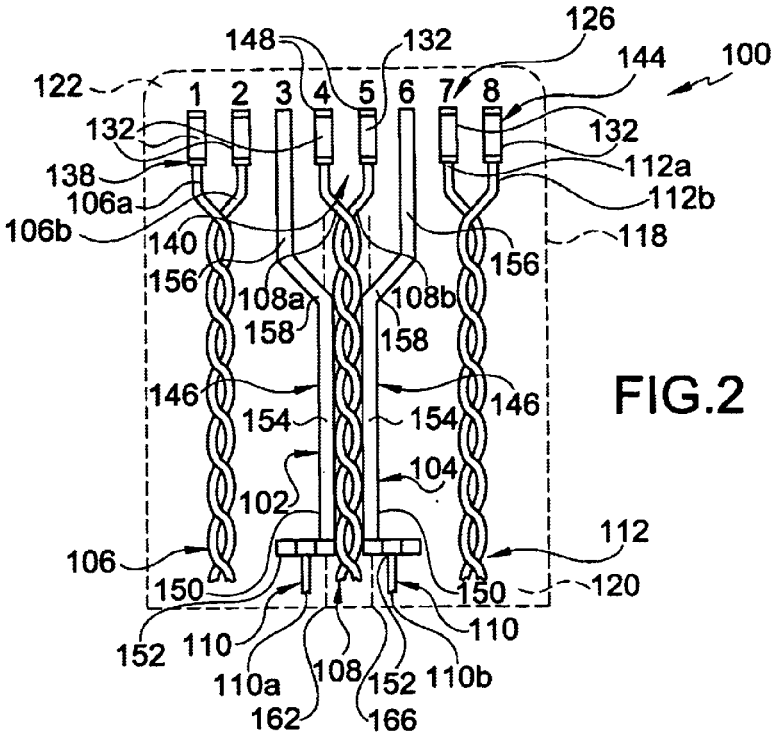
FIG. 2 is a top plan view of the electrical connector illustrated in FIG. 1, showing first, second, third and fourth wires pairs and the lead frames connected to the connector.

The array of electrical contacts 126 represent terminal assignments. 1–8, respectively, as seen in FIGS. 1 and 2. Non-insulated conductive members or lead frames 102 and 104 are supported in inner receiving area 124. Electrical connector 100 is connected to four insulated wire pairs including a first wire pair 106, a second wire pair 108, a third wire pair 110 and a fourth wire pair 112. First, second and fourth wire pairs 106, 108 and 112 are connected to the array of electrical contacts 126. Third wire pair 110 is connected to conductive lead frames 102 and 104. The designation of the wire pairs as first, second, third or fourth merely facilitates description of the wire pairs such that any of the wire pairs can be either first, second, third or fourth.

At terminal positions 1, 2, 4, 5, 7 and 8, respectively, the array of electrical contacts 126 includes metallic pins 132 received in slots 128, as seen in FIG. 1. Pins 132 are generally flat and each have an insulation piercing end 134 and an opposite contact end 136, as is well known in the art. Pins 132 at terminal positions 1 and 2 form a first pair of electrical contacts 138 of the array of electrical contacts 126 and electrically and mechanically engage wires 106*a* and 106*b*, respectively, of first wire pair 106 via insulation piercing end 134. Similarly, pins 132 at terminal positions 4 and 5 form a second pair of electrical contacts 140 and engage wires 108*a* and 108*b*, respectively, of second wire pair 108 in a similar manner. Pins 132 at terminal positions 7 and 8 form a fourth pair of electrical contacts 144 and engage wires 112*a* and 112*b*, respectively, of fourth wire pair 112 in a similar manner.

Figure 5:
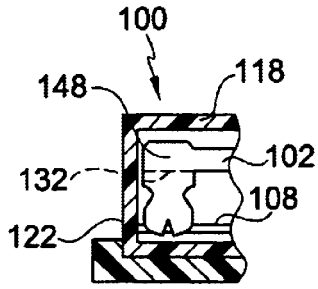
FIG. 5 is a partial side elevational view in section similar to FIG. 4, showing a staggered arrangement of a lead frame and a metallic pin.
Figure 4:
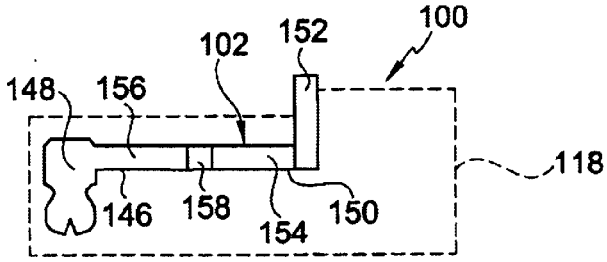
FIG. 4 is a side elevational view of a lead frame of the electrical connector illustrated in FIG. 1.

First and second non-insulated conductive members 102 and 104 are disposed at terminal positions 3 and 6. Members 102 and 104 are preferably conductive lead frames or blades, however, members 102 and 104 can be any known conductive member, such as a beam or rod. Each conductive lead frame 102 and 104 includes a main portion 146 extending between a contact end 148 and a wire connection end 150, as seen in FIGS. 2 and 3. Contact ends 148 are received in slots 128 at terminal positions 3 and 6, respectively, and form the third pair of electrical contacts 142 of the array of electrical contacts 126. Contact ends 148 are shaped similarly to pins 132 and can either include or exclude an insulation piercing end similar to pins 132. Each wire connection end 150 of lead frames 102 and 104 includes a conventional insulation displacement contact 152 for electrically and mechanically engaging insulated wires 110*a* and 110*b*, respectively, of third wire pair 110, as seen in FIGS. 1 and 3. Wires 110*a* and 110*b* of third wire pair 110 can also be twisted in a conventional manner like first, second and fourth wire pairs 106, 108 and 112. Pins 132 and/or pins 132 and contact ends 148 of lead frame frames 102 and 104 can be staggered or offset, as seen in FIG. 5.

Main portions 146 of each lead frame 102 and 104 includes first and second sections 154 and 156 and an angled section 158 disposed therebetween. The shape of main portions 146 is adapted to control inductance/capacitance of the wires and can be adjusted as needed to provide the appropriate balance of inductance/capacitance between the wires needed to reduce crosstalk. First section 154 is located near wire connection end 150 and second section 156 is located near contact end 148. Each lead frame 102 and 104 preferably extends from close to input end 120 to output end 122, as best seen in FIG. 2.

Angled section 158 of first lead frame 102 extends outwardly from first section 154 toward a first side 160 of dielectric body 118 at an acute angle from a longitudinal axis 162, as seen in FIG. 2, defined by first section 154 of first lead frame 102. Likewise, angled section 158 of second lead frame 104 extends outwardly from first section 154 of second lead frame 104 toward a second side 164 of dielectric body 12 that is opposite first side 160, at an acute angle from a longitudinal axis 166 defined by first section 154 of second lead frame 102. Lead frames 102 and 104 are oriented such that the first sections 154 of frames 102 and 104 are substantially parallel, the second sections 156 of frames 102 and 104 are substantially parallel and angled sections 158 diverge from one another towards output end 122 of dielectric body. As seen in FIG. 2, the distance between first sections 154 is substantially less than the distance between second sections 156 so that first sections 154 remain closer to one another than second sections 156.

Angled sections 158 allow lead frames 102 and 104 to straddle terminal positions 4 and 5 near output end 122 of dielectric body 118 and connect to slots 128 at terminal positions 3 and 6, respectively. The structure of lead frames 102 and 104 allows straddling of terminal positions 4 and 5 closer to output end 122 than conventional plugs thus reducing crosstalk. Because lead frames 102 and 104 remain parallel and in close proximity to each other at their first sections 154 for a substantial portion of the length of dielectric body 118, a balance of inductance/capacitance is maintained particularly between frames 102 and 104 and the wire pairs. Also, lead frames 102 and 104 provide even spacing between the wires, thereby reducing crosstalk. In particular, lead frame 102 is spaced from wire 106*b* of first wire pair 106 connected to terminal position 2 and lead frame 104 is spaced from wire 112*a* of fourth wire pair 112 connected to terminal position 7. Additionally, the gap 170, as seen in FIG. 3, defined between lead frames 102 and 104 and the first, second and fourth twisted wire pairs 106, 108 and 112 also reduces crosstalk by fixing and controlling the spacing between the frames and twisted wire pairs.

Assembly of first, second, third and fourth wire pairs 106, 108, 110 and 112 to electrical connector 100 involves mechanically and electrically connecting the individual wires of the wire pairs to the array of electrical contacts 126 at each terminal position 1 through 8 in dielectric body 118. Specifically, the wires 106*a* and 106*b* of first wire pair 106 are twisted, inserted into inner receiving area 124 of dielectric body 118 via access opening 172. The ends of wires 106*a* and 106*b* are separated and placed in slots 128 at terminals positions 1 and 2, respectively. Similarly, the first and second wires 108*a* and 108*b* of second wire pair 108 are twisted, inserted into body 112 and their ends separated and placed in terminal slots 128 at positions 4 and 5, respectively. Likewise, the first and second wires 112*a* and 112*b* of fourth wire pair 112 are twisted and their ends separated and placed in terminals slots 128 at positions 7 and 8, respectively. Metallic pins 132 are placed into each terminal slot 128 at positions 1, 2, 4, 5, 7 and 8 and mechanically and electrically connected to wire pairs 1, 2 and 4, respectively, via the insulation piercing ends 134 in a conventional manner.

Several methods can be used to connect lead frames 102 and 104 and third wire pair 110 to electrical connector 100. Preferably, first and second wires 110*a* and 110*b* are twisted with their ends separated and connected mechanically and electrically in a conventional manner to the insulation displacement contacts 152 of wire connection ends 150 of each frame 102 and 104. Lead frames 100 and 102 are inserted into inner receiving area 124 and contact ends 148 of each frame 102 and 104 are placed in slots 128 of body 118 at terminal positions 3 and 6. However, wires 110*a* and 110*b* can be connected to insulation displacement contacts 152, respectively, either before or after lead frames 102 and 104 are placed in dielectric body 118. Insulation displacement contacts 152 extend outside of body 118, as seen in FIGS. 1 and 3, with wires 110*a* and 110*b* also being outside of body 118. Boot 130, seen in FIG. 1, covers the exposed wires 110*a* and 110*b* and insulation displacement contacts 152 of each lead frame 100 and 102. Alternatively, each lead frame 102 and 104 can be made small enough to fit entirely within inner receiving area 124 of body 118 with contact ends 148 of each lead frame 102 and 104 being placed in terminal slots 128 at terminal positions 3 and 6. Also, a conventional strain relief mechanism (not shown) can be provide to hold the cable and dielectric body 118 together.

Although it is preferable that lead frames 102 and 104 are used at terminal positions 3 and 6 of connector 100, frames 102 and 104 can be employed in any of the terminal positions 1 through 8. Also, a plurality or more than two lead frames, similar to lead frames 102 and 104 can be incorporated into connector 100. For example, four lead frames can be used in combination with two twisted wire pairs.

Figure 6:
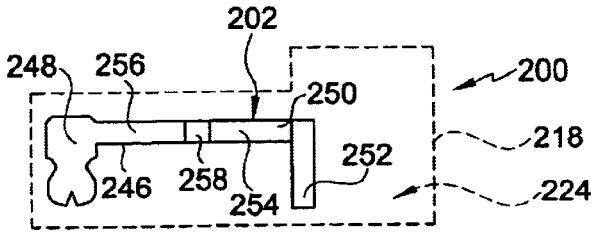
FIG. 6 is a side elevational view of an electrical connector in accordance with a second embodiment of the present invention, showing an alternative lead frame structure.

Embodiment of FIG. 6

Referring to FIG. 6, electrical connector 200 is substantially identical to connector 100 of the first embodiment. A lead frame 202 of connector 200 is an alternative structure for lead frames 102 and 104 of connector 100. To facilitate description, the same reference numerals are used but in the 200 series instead of the 100 series.

Lead frame 202 is similar to lead frames 102 and 104 and is employed with electrical connector 200 in the same manner as described above for frames 102 and 104 and connector 100. Like frames 102 and 104, lead frame 202 includes a main portion 246 extending between a contact end 248 and a wire connection end 250. Main portion 246 includes first and second sections 254 and 256 with an angled section 258 therebetween. Wire connection end 250 of frame 202 includes an insulation displacement contact 252 that extends in an opposite direction of that of insulation displacement contacts 152 of frames 102 and 104 or into inner receiving area 224 of the dielectric body 218. Frame 202 is preferably sized to fit within body 218, as seen in FIG. 6, but can also extend outside of body 218.

Figure 7:
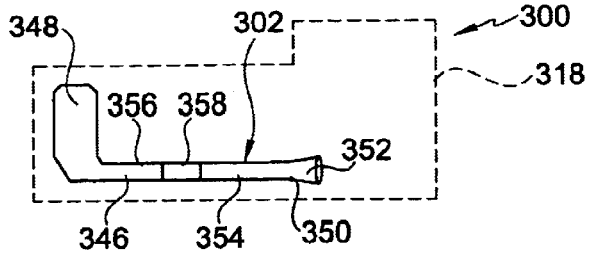
FIG. 7 is a side elevational view of an electrical connector in accordance with a third embodiment of the present invention showing another alternative lead frame structure.

Embodiment of FIG. 7

Referring to FIG. 7, electrical connector 300 is substantially identical to connector 100 of the first embodiment. A lead frame 302 of connector 300 is another alternative structure for lead frames 102 and 104 of connector 100. To facilitate description, that same reference numerals are used but with the 300 series.

Lead frame 302 is employed with electrical connector 300 in the same manner as described above for frames 102 and 104 and connector 100. Like frames 102 and 104, lead frame 302 includes a main portion 346 extending between a contact end 348 and a wire connection end 350. Main portion 346 includes first and second sections 354 and 356 with an angled section 358 therebetween. Unlike frames 102 and 104, wire connection end 350 of frame 302 includes a terminal end 352 that is aligned with first section 354. Wires are preferably crimped to frames 302 are end 352. However, a conventional insulation displacement contact can also be provided at terminal end 352. Frame 302 is preferably sized to fit within body 318, as seen in FIG. 7, but can also extend outside of body 318.

Figure 8:
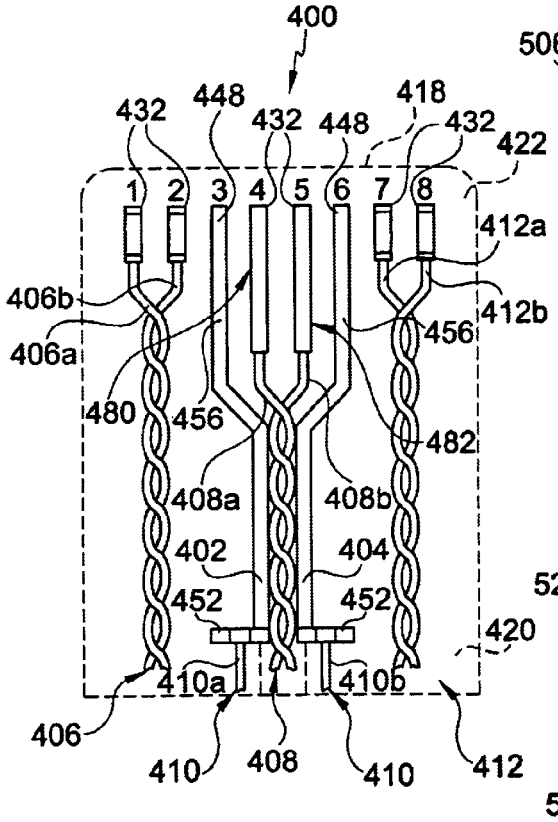
FIG. 8 is a top plan view of an electrical connector in accordance with a fourth embodiment of the present invention, showing first, second, third and fourth wires pairs and the lead frames connected to the connector.

Embodiment of FIG. 8

Referring FIG. 8, an electrical connector 400 in accordance with an fourth embodiment of the present invention is substantially similar to and used and assembled in substantially the same manner as electrical connector 100 of the first embodiment. To facilitate description, the same reference numerals are used but in the 400 series and only the distinctions between connectors 400 and 100 are described.

Similar to connector 100, connector 400 includes a dielectric body 418, first, second, third and fourth wire pairs 406, 408, 410 and 412, and first and second lead frames 402 and 404. Metallic pins 432 are each received in terminal positions 1, 2, 4, 5, 7, 8 and connected to wires 406*a*, 406*b*, 408*a*, 408*b*, 412*a* and 412*b*, respectively, and contact ends 448 of frames 402 and 404 are received in positions 3 and 6, in the same manner as described above. Wires 410*a* and 410*b* are connected to insulation displacement contacts 452 of frames 402 and 404.

Unlike connector 100, wires 408*a* and 408*b* of second wire pair 408 each include non-insulated conductive portions 480 and 482, such as conductive frames or blades, connected to pins 432 at terminal positions 4 and 5. Wires 408*a* and 408*b* can be connected to frame portions 480 and 482 in any conventional manner, such as crimping or use of insulation displacement contacts. Preferably, frame portions 480 and 482 and pins 432 at positions 4 and 5, respectively, form unitary members, as seen in FIG. 8. However, frame portions 480 and 482 and their respective pins 432 can be separate members that are integrally attached. Frames portions 480 and 482 are preferably parallel to one another and parallel to second sections 456 of lead frames 402 and 404. Second sections 456 of frames 402 and 404 can be longer than second sections 156 of lead frames 102 and 104 of connector 100, to accommodate frame portions 480 and 482. Otherwise, lead frames 402 and 404 are substantially the same as lead frames 102 and 104.

Although it is preferable to use frame portions 480 and 482 only with wires 408*a* and 408*b* of second wire pair 408, similar frame portions can be used with the wires 406*a*, 406*b*, 412*a* and 412*b* of first and fourth wire pairs 406 and 412.

Figure 9:
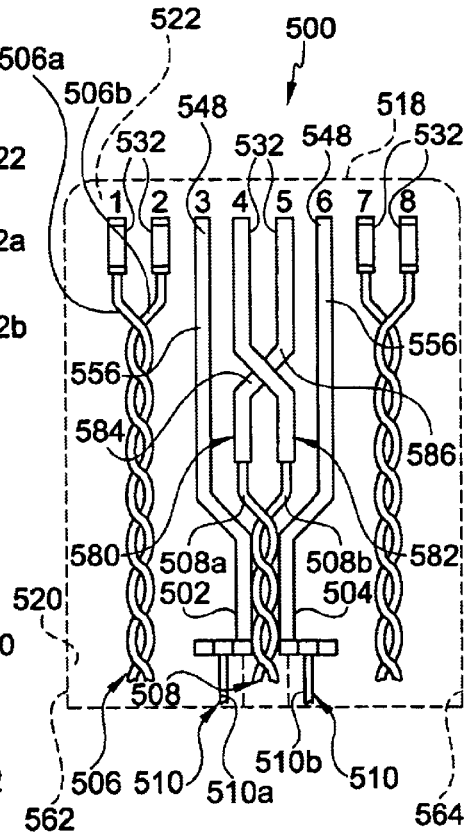
FIG. 9 is a top plan view of an electrical connector in accordance with a fifth embodiment of the present invention, showing first, second, third and fourth wires pairs and the lead frames connected to the connector.

Embodiment of FIG. 9

Referring FIG. 9, an electrical connector 500 in accordance with a fifth embodiment of the present invention is substantially similar to and used and assembled in substantially the same manner as electrical connectors 100 and 400. To facilitate description, the same reference numerals are used but in the 500 series and only the distinctions between the connector 500 and the connectors 100 and 400 are described.

Similar to connectors 100 and 400, connector 500 includes a dielectric body 518, first, second, third and fourth wire pairs 506, 508, 510 and 512, and first and second lead frames 502 and 504. Metallic pins 532 are each received in terminal positions 1, 2, 4, 5, 7, 8 and connected to wires 506*a*, 506*b*, 508*a*, 508*b*, 512*a* and 512*b*, respectively, and contact ends 548 of frames 502 and 504 are received in positions 3 and 6, in the same manner as described above. Wires 510*a* and 510*b* are connected to insulation displacement contacts 552 of frames 502 and 504.

Like connector 400, wires 508*a* and 508*b* of second wire pair 508 each include non-insulated conductive portions 580 and 582, such as conductive frames or blades, connected to pins 532 at terminal positions 4 and 5. Wires 508*a* and 508*b* can be connected to frame portions 580 and 582 in any conventional manner, such as crimping or use of insulation displacement contacts. Preferably, frame portions 580 and 582 and pins 532 at positions 4 and 5, respectively, form unitary members, as seen in FIG. 9, however, frame portions 580 and 582 and their respective pins 532 can be separate members that are integrally attached. Frame portions 580 and 582 are substantially parallel to one another except for generally centrally disposed angular sections 584 and 586 of each portions 580 and 582, respectively, that cross over one another without being electrically connected. Specifically, angular section 584 of first frame portion 580 angles toward one side 564 of dielectric body 518 and angular section 586 of second frame portion angles toward an opposite side 562. As with connector 400, second sections 556 of frames 502 and 504 of connector 500 can be longer than second sections 156 of lead frames 102 and 104 of connector 100, to accommodate frame portions 580 and 582. Otherwise, lead frames 502 and 504 are substantially the same as lead frames 102 and 104.

Although it is preferable to use frame portions 580 and 582 only with wires 508*a* and 508*b* of second wire pair 508, similar frame portions can be used with the wires 506*a*, 506*b*, 512*a* and 512*b* of first and fourth wire pairs 506 and 512.

While a particular embodiment has been chosen to illustrate the invention, it will be understood by those skilled in the art that various changes and modifications can be made therein without departing from the scope of the invention as defined in the appended claims.

What is claimed is:

1. An electrical connector, comprising:

a dielectric body having an input end and an opposite output end;

first and second non-insulated conductive lead frame members supported by said dielectric body, said first non-insulated conductive member having a first contact end and an opposite first wire connection end and said second non-insulated conductive member having a second contact end and an opposite second wire connection end, each of said first and second contact ends being proximate said output end of said dielectric body and forming a first pair of electrical contacts, and each of said second wire connection ends being proximate said input end of said dielectric body; and first and second insulated conductive members supported by said dielectric body, each of said first and second insulated conductive members being connected to one of a second pair of non-lead frame electrical contacts, respectively, and said first and second pairs of electrical contacts forming an array of electrical contacts at said output end of said dielectric body.

2. An electrical connector in accordance with claim 1, wherein said first and second insulated conductive members are twisted together.

3. An electrical connector in accordance with claim 1, wherein said second pair of electrical contacts is disposed between said electrical contacts of said first pair of electrical contacts.

4. An electrical connector in accordance with claim 1, wherein each of said conductive members is a unitary one-piece member.

5. An electrical connector in accordance with claim 1, wherein said dielectric body includes a plurality of substantially parallel slots at said output end thereof, each of said slots receiving one of said electrical contacts of said first and second pairs of electrical contacts.

6. An electrical connector in accordance with claim 1, third and fourth insulated conductive members are supported by said dielectric body, each of said third and fourth insulated conductive members being connected to one of a third pair of electrical contacts; and fifth and sixth insulated conductive members are supported by said dielectric body, each of said fifth and sixth insulated conductive members being connected to one of a fourth pair of electrical contacts, said third and fourth pairs of electrical contacts being disposed in said array of electrical contacts.

7. An electrical connector in accordance with claim 1, wherein said electrical contacts are disposed in a staggered arrangement at said output end of said dielectric body.

8. An electrical connector in accordance with claim 1, wherein each of said electrical contacts of said second pair of electrical contacts includes an insulation piercing contact end engaged with each of said first and second insulated conductive members, respectively.

9. An electrical connector in accordance with claim 1, wherein said wire connection ends of said first and second non-insulated conductive members include insulation displacement contacts engaged with insulated conductive members.

10. An electrical connector in accordance with claim 1, wherein each of said wire connection ends of said first and second non-insulated conductive members is substantially perpendicular to a main portion of the respective non-insulated conductive members and extends outside of said dielectric body.

11. An electrical connector in accordance with claim 1, wherein each of said wire connection ends of said first and second non-insulated conductive members is substantially perpendicular to a main portion of the respective non-insulated conductive members and extends inside of said dielectric body.

12. An electrical connector in accordance with claim 1, wherein each of said wire connection ends of said first and second non-insulated conductive members is aligned with a portion of the respective non-insulated conductive members and extends towards said input end of dielectric body.

13. An electrical connector in accordance with claim 1, wherein said first and second insulated conductive members are wires.

14. An electrical connector in accordance with claim 1, wherein said input end of said dielectric body receives a cable; and said output end of said dielectric body connects to a mating connector.

15. An electrical connector in accordance with claim 1, wherein said input end and said output end of are disposed at opposite longitudinal ends of said dielectric body.

16. An electrical connector in accordance with claim 1, wherein said first and second insulated conductive members and said first and second non-insulated being conductive members are laterally spaced from each other along at least a portion of a length of said dielectric body between said ends thereof.

17. An electrical connector in accordance with claim 1, wherein each of said first and second non-insulated conductive members includes first and second sections;

said first sections of said first and second non-insulated conductive members being proximate said wire connection ends of said first and second non-insulated conductive members and being substantially parallel; and said second sections of said first and second non-insulated conductive members being proximate said contact ends and being substantially parallel with a distance between said second sections being greater than a distance between said first sections.

18. An electrical connector in accordance with claim 17, wherein each of said first and second non-insulated conductive members includes an angled section disposed between said first and second sections thereof, said angled sections diverging from one another towards said output end of said dielectric body.

19. An electrical connector in accordance with claim 1, wherein each of said first and second insulated conductive members includes a non-insulated portion connected to one of said electrical contacts of said second pair of electrical contacts.

20. An electrical connector in accordance with claim 19, wherein said non-insulated portions and said electrical contacts connected thereto form unitary one-piece members.

21. An electrical connector in accordance with claim 19, wherein said non-insulated portions are parallel to sections of said first and second non-insulated conductive members.

22. An electrical connector in accordance with claim 19, wherein each of said non-insulated portions includes an angled section; and said angled sections cross over one another.

23. An electrical connector, comprising:

a dielectric body having an input end and an opposite output end;

first and second non-insulated conductive lead frames supported by said dielectric body, each of said first and second non-insulated conductive frames having opposite contact and wire connection ends at said output and input ends of said dielectric body, respectively, and a main portion disposed there between, each said main portion having a first section located proximate said wire connection end, a second section located proximate said contact end, and an angled section disposed between said first and second sections, said first sections of said conductive frames being substantially parallel, said second sections of said conductive frames being substantially parallel, said angled sections diverging from one another toward said output end of said dielectric body; and first and second twisted insulated wires supported by said dielectric body, each of said first and second twisted insulated wires being connected to one of a second pair of non-lead frame electrical contacts, said first and second pairs of electrical contacts forming an array of electrical contacts at said output end of said dielectric body.

24. An electrical connector in accordance with claim 23, wherein said second pair of electrical contacts is disposed between said electrical contacts of said first pair of electrical contacts.

25. An electrical connector in accordance with claim 23, wherein third and fourth twisted insulated wires are supported by said dielectric body, each of said third and fourth twisted insulated wires being connected to one of a third pair of electrical contacts; and fifth and sixth twisted insulated wires are supported by said dielectric body, each of said fifth and sixth twisted insulated wires being connected to one of a fourth pair of electrical contacts, said third and fourth pairs of electrical contacts being disposed in said array of electrical contacts.

26. An electrical connector in accordance with claim 23, wherein each of said first and second twisted insulated wires includes a non-insulated frame portion connected to one said electrical contacts of said second pair of electrical contacts, said non-insulated portions and said electrical contacts connected thereto form unitary one-piece members.

27. An electrical connector in accordance with claim 23, wherein said non-insulated frame portions are parallel to sections of said first and second non-insulated frames.

28. An electrical connector in accordance with claim 23, wherein each of said non-insulated frame portions includes an angled section; and said angled sections cross over one another.

29. An electrical connector in accordance with claim 23, wherein said input end of said dielectric body receives a cable; and said output end of said dielectric body connects to a mating connector.

30. An electrical connector in accordance with claim 23, wherein said input end and said output end of are disposed at opposite longitudinal ends of said dielectric body.

31. An electrical connector in accordance with claim 23, wherein said first and second insulated conductive members and said first and second non-insulated conductive members are laterally spaced from each other along at least a portion of a length of said dielectric body between said ends thereof.

32. An electrical connector, comprising:

a dielectric body having an input end and an opposite output end;

first and second non-insulated conductive members supported by said dielectric body, said first non-insulated conductive member having a first contact end and an opposite first wire connection end and said second non-insulated conductive member having a second contact end and an opposite second wire connection end, each of said first and second contact ends being proximate said output end of said dielectric body and forming a first pair of electrical contacts, and each of said second wire connection ends being proximate said input end of said dielectric body; and first and second insulated conductive members supported by said dielectric body, each of said first and second insulated conductive members being connected to one of a second pair of electrical contacts, respectively, and being laterally spaced from said first and second non-insulated conductive members along at least a portion of a length of said dielectric body, and said first and second pairs of electrical contacts forming an array of electrical contacts at said output end of said dielectric body.

33. An electrical connector according to claim 32, wherein said first and second insulated conductive members are twisted together.

34. An electrical connector according to claim 32, wherein said second pair of electrical contacts is disposed between said electrical contacts of said first pair of electrical contacts.

35. An electrical connector according to claim 32, wherein said input end of said dielectric body receives a cable; and said output end of said dielectric body connects to a mating connector.

36. An electrical connector according to claim 32, wherein said input end and said output end of are disposed at opposite longitudinal ends of said dielectric body.

* * * * *